United States Patent [19]

Langer et al.

[11] 4,137,963

[45] Feb. 6, 1979

[54] STRAND GUIDING ROLLER TO BE USED IN A CONTINUOUS CASTING PLANT

[75] Inventors: Konrad Langer, Linz; Kurt Feix, Steyr-Gleink, both of Austria

[73] Assignee: Vereinigte Österreichische Eisen- und Stahlwerke - Alpine Montan Aktiengesellschaft, Linz, Austria

[21] Appl. No.: 832,162

[22] Filed: Sep. 12, 1977

[30] Foreign Application Priority Data

Oct. 13, 1976 [AT] Austria ..... 7600/76

[51] Int. Cl.[2] ..... B22D 11/00

[52] U.S. Cl. ..... 164/448; 164/442

[58] Field of Search ..... 164/442, 448; 72/201, 72/236; 29/110; 165/89, 90

[56] References Cited

U.S. PATENT DOCUMENTS

| | | | |
|---|---|---|---|
| 2,956,348 | 10/1960 | Mueller | 165/89 |
| 3,604,237 | 9/1971 | Kawanami | 165/89 |
| 3,662,821 | 5/1972 | Saxon | 165/89 |
| 3,981,348 | 9/1976 | Schmucker | 164/448 |

FOREIGN PATENT DOCUMENTS

| | | | |
|---|---|---|---|
| 257892 | 4/1927 | United Kingdom | 165/89 |

*Primary Examiner*—Richard B. Lazarus
*Assistant Examiner*—K. Y. Lin
*Attorney, Agent, or Firm*—Brumbaugh, Graves, Donohue & Raymond

[57] ABSTRACT

A continuous casting plant strand guiding roller has a stationary axle and at least three roller bodies journaled thereon, each provided with an annular recess to accommodate bearings. The stationary axle is provided with longitudinal channels, and radial channels originate from the longitudinal channels and extend to the annular recess provided in each roller body, thus forming a coolant and/or lubricant medium circuit. At least two neighbouring roller bodies are always connected to one medium circuit.

7 Claims, 3 Drawing Figures

STRAND GUIDING ROLLER TO BE USED IN A CONTINUOUS CASTING PLANT

BACKGROUND OF THE INVENTION

The invention relates to a strand guiding roller to be used in continuous casting plants and having at least three roller bodies journaled on a stationary axle, wherein the axle is provided with longitudinal channels and wherein radial channels originating from the longitudinal channels lead to a bearing-accommodating annular recess of the roller body for producing a coolant and/or lubricant circuit.

In strand guiding rollers of this kind each roller body is separately provided with its own supply and drain conduit for the coolant and/or lubricant. These supply and drain conduits are guided parallel to each other through the stationary axle. In particular with strand guiding rollers having a great number of roller bodies, such as those used in continuous casting plants for slabs, a multiplicity of channels must be provided in the axle of each strand guiding roller, hence the production of such a roller is complicated and expensive. Furthermore, each channel has to be connected to a pipe conduit for supplying or draining the coolant and/or lubricant, which increases the costs of the continuous casting plant and impairs its accessibility.

Strand guiding rollers must have as uniform a course of temperature as possible over their longitudinal extension so that the roller is subjected to a largely uniform thermal wear over its longitudinal axis. This requirement is opposed by the thermal influence of the strand, in particular of a wide slab. The roller is heated to the greatest extent at its middle portion, which is contacted by the hottest region of the strand and from which it is most difficult to conduct away the heat. Accordingly, the bearings arranged in or near the middle of the roller are subjected to the greatest thermal wear, and thus they have the greatest fault liability and are worn earlier than the bearings arranged closer to the two ends of the roller.

SUMMARY OF THE INVENTION

The invention aims at avoiding these disadvantages and difficulties and has as its object to provide a strand guiding roller which is easy to produce, which works with great operational safety, and whose bearings and roller bodies are maintained at as equal a temperature as possible during the continuous casting.

According to the invention, these objects are achieved in that at least two neighbouring roller bodies are always connected in one coolant and/or lubricant circuit, wherein a longitudinal channel of the axle serving for the supply of the coolant and/or lubricant leads to the roller body arranged closer to the middle of the roller and subjected to greater thermal wear during the operation, and the returning coolant, starting from there, is lead meander-like to the outside via radial channels, annular recesses in the roller bodies, and longitudinal channel sections.

According to a preferred embodiment, an even number of roller bodies is adjacently arranged, wherein from each end of the roller one longitudinal channel each, leads to the bearings arranged most closely to the middle of the roller, and the coolant and/or lubricant from there is guided to the outside through the annular recesses of the roller bodies, one after the other. This embodiment is the most suitable one for rollers having an even number of roller bodies.

If a strand guide roller has an uneven number of roller bodies, suitably the annular recess of a roller body arranged in the middle of a roller is provided with a separating wall, wherein one longitudinal channel leads from each end of the roller to the separating wall and from there runs into the recess with a radial channel and wherein the coolant and/or lubricant from there runs meander-like through radial and longitudinal channel sections into the annular recesses of the roller bodies arranged closer to the ends of the roller.

BRIEF DESCRIPTION OF THE DRAWINGS

The invention shall now be described by way of example only and with reference to the accompanying drawing, wherein.

DESCRIPTION OF EXEMPLARY EMBODIMENTS

Figures 1, 2, 3:
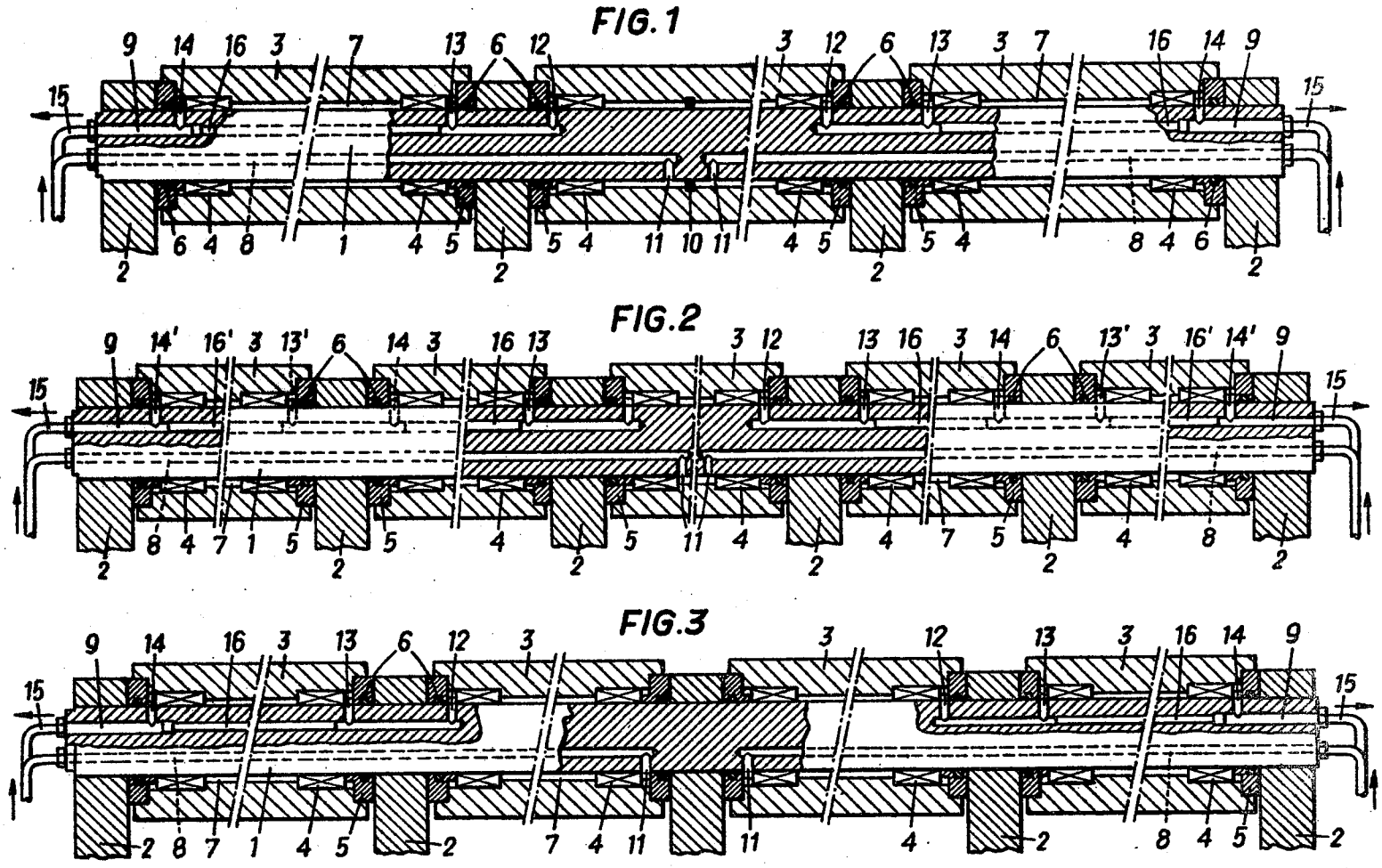
FIG. 1 is a longitudinal section of a strand guiding roller having three roller bodies.
FIGS. 2 and 3 are longitudinal sections of a strand guiding roller having four and five roller bodies, respectively.

A roller axle 1 is secured in a supporting construction (not illustrated in detail) via axle holders 2. In order to avoid an unpermissibly pronounced sagging of the roller axle when the strand guiding roller is loaded by the strand, the axle holders are distributed over the longitudinal extension of the roller axle. One cylindrical roller body 3 is arranged between each pair of neighbouring axle holders 2, which roller body at its ends is journaled on the roller axle 1 by anti-friction bearings 4. Instead of anti-friction bearings, slide bearings can also be provided. Towards the outside, the roller bodies are sealed by closing discs 5 in which sealing rings 6 are inserted. The inner diameter of the roller bodies is wider than the out diameter of the roller axis 1 in order to form an annular recess 7. Starting from each end, two channels 8 and 9, that are parallel to each other as well as to the roller axis, are provided in the roller axle, which channels are constructed as bores.

According to the embodiment of FIG. 1 which shows a strand guiding roller having three roller bodies, the annular recess of the middle roller body 3 is divided into two parts by an annular separating wall 10 arranged in the middle thereof. Originating from each roller end, bores 8 extend to slightly in front of each side of the separating wall 10, respectively, and run into the annular recess 7 via approximately radially directed bores 11. Through these channels coolant and/or lubricant is supplied to the annular recess 7 located approximately in the middle of the roller, and starting from there it is guided to both sides towards the bearings at the ends of the middle roller body 3. It penetrates these bearings and, via radial bores 12, reaches the axial bores 9 which each extend to an end of the roller axle. Via these axial bores 9 and via further radial bores 13 running thereinto, the coolant and/or lubricant is supplied to those bearings of the roller bodies at the ends of the roller which are located most closely to the middle of the roller, and from there it flows to the bearings of the bodies located at the ends of the roller via the annular recesses 7 of these roller bodies. After flowing through recesses 7, it flows back via further radial bores 14 into the axial bores 9 and via these axial bores 9 it flows to the drain conduits 15 connected thereto. Between each of the pairs of radial bores 13 and 14, one bolt 16 filling the bore cross-section of the axial bore 9, is inserted for deflecting the coolant or lubricant.

Advantageously, for cooling and lubricating the roller bodies or their bearings, a coolant-lubricant mixture is lead through the channels, such as, e.g., an emulsion of water and a lubricant.

FIG. 2 shows a strand guiding roller having five roller bodies, which, in principle, is designed in the same manner as the roller according to FIG. 1 that has three roller bodies. For deflecting the coolant or lubricant, two bolts 16 and 16' located at a distance behind each other are inserted in the axial bores 9 through which the coolant or lubricant flows back. These bolts are each arranged between the radial bores 13 and 14, as well as 13' and 14', so that the roller bodies arranged adjacent the middle roller body as well as the two roller bodies journaled at the ends of the roller axle are also flowed through by coolant and lubricant.

FIG. 3 shows a strand guiding roller having an even number of roller bodies. With such a roller, the coolant and lubricant is always supplied from the two ends of the roller to the bearings arranged nearest to the middle of the roller. The coolant and lubricant are transmitted from one roller body to the next one via another axial bore whose free cross-section is restricted in its length by bolts inserted into it, as well as via radial bores and annular recesses of the roller bodies.

What we claim is:

1. In a strand guiding roller to be used in a continuous casting plant and of the type including a stationary axle, at least three roller bodies journaled on said axle and each provided with an interior annular recess, bearings for supporting the roller bodies accommodated in each annular recess, at least two longitudinal channels provided in said stationary axle, radial channels originating from said longitudinal channels and extending to said annular recess provided in each roller body, thus forming a medium circuit, the improvement which is characterized in that at least two neighbouring roller bodies are always connected to one medium circuit, one of the longitudinal channels provided in said axle serving for supplying the medium to the roller body arranged closest to the middle of the roller and subjected to the greatest thermal wear during operation, and said medium flowing back in a meander-like manner through said radial channels, said annular recesses provided in the roller bodies, and sections of another one of said longitudinal channels.

2. A strand guiding roller as set forth in claim 1, wherein said medium is a coolant.

3. A strand guiding roller as set forth in claim 1, wherein said medium is a lubricant.

4. A strand guiding roller as set forth in claim 1, wherein said medium is a coolant and a lubricant.

5. A strand guiding roller as set forth in claim 1, wherein an even number of roller bodies are adjacently arranged, said one longitudinal channel extends from each end of said roller to each side of the bearing arranged closest to the middle of said roller, the medium being guided through the annular recesses of the roller bodies, the radial bores and sections of another one of said longitudinal channels, one after the other to outside.

6. A strand guiding roller as set forth in claim 1, wherein an uneven number of roller bodies is provided, the annular recess provided in the roller body arranged in the middle of the roller being provided with a separating wall, said one longitudinal channel starting from each end of the roller and extending to the vicinity of each side of said separating wall and being connected to said recess via a radial channel, the medium being guided from said recess provided in the roller body arranged in the middle of the roller via sections of radial channels and sections of another one of said longitudinal channels into the annular recesses of the roller bodies arranged closer to the ends of the roller.

7. A strand guiding roller as set forth in claim 5 wherein said another one of said longitudinal channels is divided into sections by means of bolts located in the channel between the radial channels associated with roller bodies, said bolts blocking the cross section of the channel.

* * * * *